United States Patent [19]

Kitamura et al.

[11] Patent Number: 4,779,991

[45] Date of Patent: Oct. 25, 1988

[54] BOTTLE FOR MIXING AND METHOD FOR MIXING WITH THE SAID BOTTLE

[75] Inventors: Masaru Kitamura, Hyogo; Hiroshi Sasaki, Osaka; Shoji Konishi, Kyoto, all of Japan

[73] Assignee: Wako Pure Chemical Industries Ltd., Osaka, Japan

[21] Appl. No.: 173

[22] Filed: Jan. 2, 1987

[30] Foreign Application Priority Data

Jan. 16, 1986 [JP] Japan ..... 61-4398[U]
Jan. 16, 1986 [JP] Japan ..... 61-7039

[51] Int. Cl.[4] ..... B65D 3/04

[52] U.S. Cl. ..... 366/130; 206/219; 215/DIG. 8

[58] Field of Search ..... 366/129, 130, 602, 240; 206/219, 220, 221; 220/354, 23; 215/355, DIG. 8

[56] References Cited

U.S. PATENT DOCUMENTS

| | | | |
|---|---|---|---|
| 1,115,597 | 11/1914 | Sherman | 215/355 |
| 1,218,662 | 3/1917 | Ingram | 215/355 |
| 3,842,514 | 10/1974 | Scheyer | 215/355 |
| 3,857,423 | 12/1974 | Ronca | 206/219 |
| 4,227,620 | 10/1980 | Conway | 215/355 |

*Primary Examiner*—Robert W. Jenkins
*Attorney, Agent, or Firm*—Cushman, Darby & Cushman

[57] ABSTRACT

This invention relates to a bottle and a method of mixing with the bottle capable of readily mixing solute or dispersoid and liquid contained in different bottles as required.

This invention employs as one bottle a glass or hard plastic bottle like a Vial and as the other bottle a flexible plastic bottle, both bottles are engaged and fluctuated to mix the solute or dispersoid in the liquid.

4 Claims, 3 Drawing Sheets

BOTTLE FOR MIXING AND METHOD FOR MIXING WITH THE SAID BOTTLE

BACKGROUND OF THE INVENTION

This invention relates to a bottle for readily mixing solute or dispersoid and liquid contained in different bottles as required and a method of effectively mixing solute or dispersoid, such as freeze-drying product and liquid, such as buffer solution, contained in different bottles as required to dissolve or disperse the solute or dispersoid in the liquid.

In commodities, such as clinical diagnostic reagents, a substance to be dissolved (solute), such as freeze-drying product like enzyme or other powder, and solubilizer (solvent), such as buffer solution for dissolving the solute are frequently contained in different containers like bottles in most cases, and it is designated to mix both for use as required. In this case, a solute bottle 2 and a solvent bottle 1 are frequently connected by a connector 3 as shown in FIG. 1 due to the reasons that it is difficult to remove all quatity of solute from the bottle and that the contamination of the contents is prevented, and both are fluctuated and mixed for many cases.

In this case, there arise many inconveniences and difficulties in which the connector must be maintained clean, and that the connector must be always prepared for one set of bottles to prevent the contents from being contaminated.

SUMMARY OF THE INVENTION

An object of this invention is to provide a bottle for mixing and a method of effectively mixing solute and solvent contained in separate bottles without connector nor anxiety of leaking or contaminating contents.

These and other objects, features and advantages of the invention will be appreciated upon a review of the following description of the invention when taken in conjunction with the attached drawings with understanding that some modifications, variations and changes may be easily accomplished by those skilled in the art to which the invention pertains without departing from the spirit of the invention or the scope of claims appended hereto.

DETAILED DESCRIPTION OF THE PREFERRED EMBODIMENTS

Embodiments of this invention will be described in detail with reference to the accompanying drawings.

Figure 1:
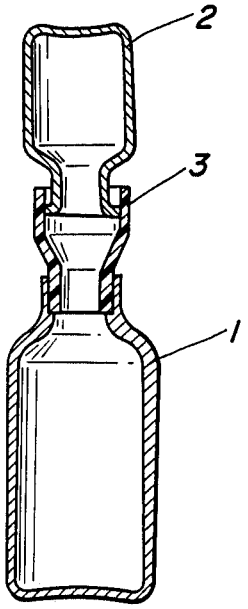
FIG. 1 (PRIOR ART)
FIG. 1 is a sectional view showing the used state of a conventional connector.
Figure 2:
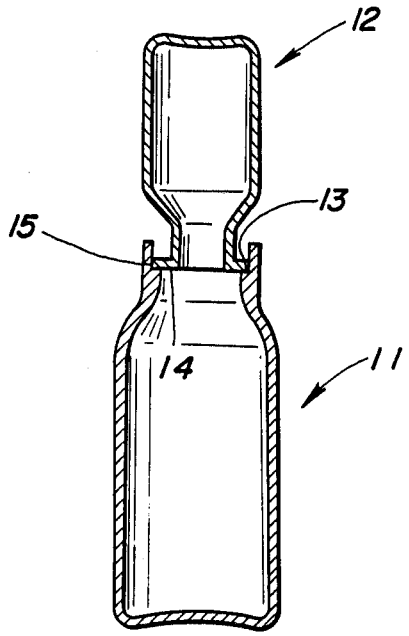
FIG. 2 is a sectional view of a bottle according to this invention.
Figure 3:
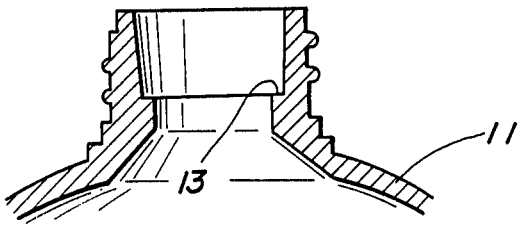
FIG. 3 is a sectional view of the neck of the bottle for solute.

FIG. 2 shows an embodiment of a bottle according to this invention. In this embodiment, a liquid bottle 11 formed with a step 13 of small diameter on the inner surface of the neck thereof, and a solute or dispersoid bottle 12 having a neck to be engaged closely with the bottle 11 are closely engaged, and the bottle 12 is connected with the step 13 of the bottle 11.

The solute or dispersoid bottle 12 may employ a glass bottle like a Vial or hard plastic bottle. The liquid bottle 11 may employ a flexible plastic bottle. The flexible plastic may preferably use a soft polyethylene, a soft polypropylene etc., due to the reason that this bottle can be used for almost all liquid contents, but this invention is not limited to these.

In order to closely engage the bottle 12 with the bottle 11 by a small force, when the bottle 12 employs the Vial or the hard plastic bottle and the bottle 11 employs the flexible plastic bottle, it is preferable to slightly reduce the inner diameter of the neck of the bottle 11 smaller than the outer diameter of the neck of the bottle 12.

In the embodiment described above, a step 13 of small diameter is formed on the inner surface of the neck of the bottle 11. This is not always necessary, but may be tapered to engage the bottle 12 with the bottle 11. Thus, since the insertion of the neck of the bottle 12 can be stopped at the step 13, it is not necessary to regulate the inserting degree of the bottle 12 into the bottle 11, but can standardize the insertion. Further, in the embodiment described above, the end 14 of the neck of the bottle 12 is formed flatly and a short ring-shaped engaging portion 15 is formed on the outer peripheral surface of the neck of the bottle 12. Thus, the liquid leakage, when the bottle are flutuated, can be prevented more reliably by the connection of the neck of the bottle 12 with the step 13 of the small diameter of the bottle 11.

In the embodiment described above, the solute or dispersoid container employs the glass bottle or hard plastic bottle and the liquid container employs the flexible plastic bottle. However, this invention is not limited to the particular embodiments. In general, large bottle may be preferably used as a liquid container.

The bottle of this invention can be applied, for example, to clinical diagnostic reagents field like the combination of enzyme and buffer solution. However,this invention is not limited to this application. For example, this invention can also be applied to the mixture of detrimental substance and solvent for dissolving the substance or high viscous liquid and solvent for dissolving the liquid.

Figure 4:
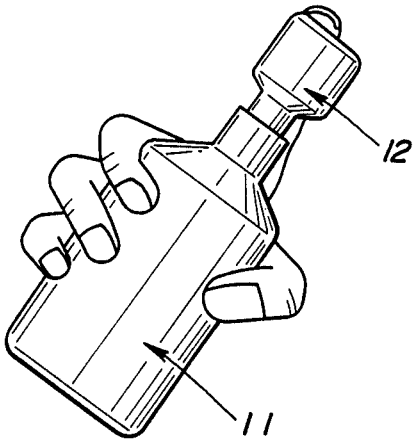
FIG. 4 is a perspective view for describing a method of mixing solute and solvent with the bottle of this invention.

In order to mx solute or dispersoid and liquid with the bottle of this invention, as shown in FIG. 4, the neck of the solute bottle 12 is engaged with that of the solvent bottle 11 and both are fluctuated.

According to the method of this invention, the possibility of liquid leakage or contamination of the contents can be extremely reduced. Since a wasteful element such as a connector is eliminated, the mixing operation can be very simplified to eliminate the drawbacks of using the connector.

What is claimed is:

1. A bottle for mixing solute or dispersoid and liquid so as to dissolve or disperse the solute or dispersoid in the liquid comprising an assembly of first and second bottles, one of said bottles containing said solute or dispersoid and the other of said bottles containing said liquid, said first bottle being in the form of a glass or rigid plastic bottle-like vial having a closed first end portion and an open neck-like second end portion, said neck having a flange disposed adjacent the open end thereof which has a flat end face and a flat outer peripheral surface defining a ring-shaped engaging portion, said second bottle being in the form of a flexible plastic bottle having a first closed end and a second open neck-like end said neck of said flexible plastic bottle having a stepped interior surface so as to define an inner small diameter portion and an outer large diameter portion, said outer diameter portion being sized so as to receive said flanged neck of said first bottle such that said flat end face sealingly engages a step intermediate said outer and inner portions of said second bottle when said bottle for mixing is assembled whereby engagement of the bottles and fluctuation of the assembled bottles mixes the solute or dispersoid in the liquid.

2. The bottle according to claim 1, wherein the larger diameter portion of the neck of the flexible plastic bottle is slightly less than the outer diameter of the engaging portion of the first bottle so as to be engaged closely by a small force with the glass or hard plastic bottle.

3. A method of mixing a solute or dispersoid and a liquid contained in first and second bottles so as to dissolve or disperse the solute or dispersoid in the liquid comprising the steps of:

providing a first bottle formed from glass or a rigid plastic bottle-like vial, said first bottle having a first closed end, a second open neck-like end, and a flange defined adjacent said open end of said neck which has a flat end face and a flat peripheral surface defining a ring-shaped engaging portion;

providing a second bottle formed from flexible plastic and having a first closed end and a second neck-like open end, the interior of said neck-like end having a stepped inner surface so as to define an outer large diameter portion and an inner small diameter portion;

inserting said neck-like end of said first bottle into said neck-like end of said second bottle such that the larger diameter portion receives said engaging portion and said flat end face sealingly engages a step defined between said outer and inner portions; and fluctuating said assembled containers to mix the solute or dispersoid in the liquid.

4. The method of mixing according to claim 3, wherein the larger diameter portion of the neck of the flexible plastic bottle is slightly less than the outer diameter of said engaging portion of the glass or hard plastic bottle.

* * * * *